United States Patent [19]

Kaminstein

[11] 4,053,676

[45] Oct. 11, 1977

[54] HANDLE GRIP MATERIAL

[75] Inventor: Bernard Kaminstein, Paramus, N.J.

[73] Assignee: Litton Industries, Inc., Fitchburg, Mass.

[21] Appl. No.: 689,830

[22] Filed: May 25, 1976

Related U.S. Application Data

[63] Continuation-in-part of Ser. No. 597,392, July 18, 1975, abandoned.

[51] Int. Cl.[2] ..... B32B 3/26

[52] U.S. Cl. ..... 428/310; 273/75; 273/81.5; 428/314; 428/321; 428/354

[58] Field of Search ..... 273/72 R, 75, 81.5; 428/306, 36, 310, 314, 315, 320, 321, 484, 351, 352, 354, 904

[56] References Cited

U.S. PATENT DOCUMENTS

| | | | |
|---|---|---|---|
| 2,306,046 | 12/1942 | Duggan et al. | 428/317 |
| 2,797,731 | 7/1957 | Carlson, Jr. | 428/310 |
| 3,144,492 | 8/1964 | Lightner | 428/314 |
| 3,173,826 | 3/1965 | Campbell et al. | 428/310 |
| 3,654,061 | 4/1972 | Berwanger | 428/157 |
| 4,016,315 | 4/1977 | Szabo | 428/315 |
| B 337,023 | 3/1976 | Ray | 428/484 |

*Primary Examiner*—William J. Van Balen

[57] ABSTRACT

A non-slip material used, e.g., as a handle grip covering provided for replacing the usual material wrapped around the handle of, for example, a golf club or tennis racket. The material may be used to cover any surface where non-slip is desired. The covering comprises a substrate coated on one side with a foamed material comprising, for example, a vinyl copolymer resinous binder containing expanded microspheres. A wax coating covers the foamed material coating. This handle covering is wrapped around a handle. It provides a non-slip, perspiration absorbing handle cover.

7 Claims, 2 Drawing Figures

HANDLE GRIP MATERIAL

CROSS REFERENCE TO RELATED APPLICATION

This application is a continuation in part of U.S. application for patent Ser. No. 597,392 filed on July 18, 1975 by Bernard Kaminstein now abandoned.

BACKGROUND OF THE INVENTION

1. Field of the Invention

This invention relates to a coating which may be applied to the handle or surface of an object for the purpose of improving the ability to grip and/or hold an object.

Objects which are used in games, such as bats, tennis rackets, golf clubs, etc., as well as tools, usually have their handles covered with some form of a wrapping in order to improve the ability to grasp that object and to enable one to hold on to that object, even though the hand might perspire in the course of the use thereof whereby, the object may slip within the grasp. A most favored material for wrapping a handle is leather, although various types of friction tape or rubber-covered tape is also sometimes used. The trouble with these, is that although they may be good when first applied, as time passes, they begin to deteriorate because of the effects of perspiration. Such handle wrapping also soon lose their ability to prevent slippage. Replacement of the handle wrapping becomes necessary. Such replacement, especially if it is leather, is rather costly.

2. Description of Prior Art

The following patents were found in a prior art search: U.S. Pat. Nos. 2,862,834; 3,535,144; 3,035,936; 3,582,391; 3,080,260; 3,585,149; 3,299,914; 3,669,899; 3,365,358; 3,730,920; 3,816,169.

OBJECT AND SUMMARY OF THE INVENTION

An object of this invention is the provision of a wrapping for a handle which is relatively inexpensive and yet provides the qualities of a leather wrapping.

Another object of this invention is to provide a novel and improved material which can be used for handle grips.

The foregoing and other objects of the invention are achieved in the preferred embodiment by coating one side of a substrate such as paper, with a pressure sensitive adhesive so that the substrate can be readily and conveniently applied to a surface by application of nothing more than manual pressure. The other side of the substrate has several coatings applied thereto. First, a foamed material coating such as an expanded microspheres containing vinyl copolymer foam coating is applied. The foamed coating imparts a soft, textured feel. Over this coating, a second coating of a latex material such as nitriel-latex may be applied. This second coating is not necessary, but does serve to increase wear properties and tack. In order to impart a nonslip character, a final coating, such as 10% solution of beeswax in toluene is applied either over the foamed material coating, or over the latex material coating when it is used. The wax complies with the surface of the hand thereby enhancing non-slip and simultaneously, repels water which might otherwise interfere with the grip.

DESCRIPTION OF THE PREFERRED EMBODIMENTS

Figure 1:
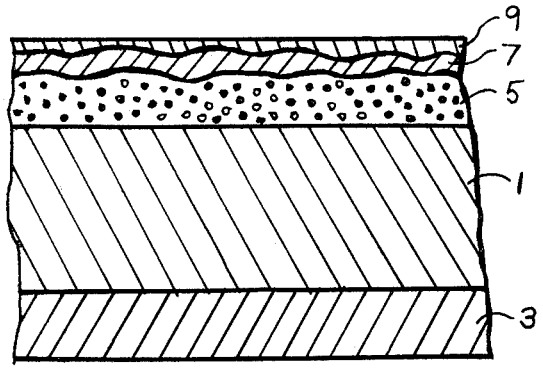
FIG. 1 is an exaggerated cross sectional view of a non-slip substrate constructed in accordance with the present invention.

In order to simulate the properties of a leather wrapping around a handle, in accordance with this invention, any paper stock, foil, or film may be used as a substrated or base 1 upon which the coatings are applied.

One side of the base is coated with a pressure sensitive adhesive 3. Pressure sensitive adhesives are well known as described, e.g., in the Handbook of Adhesives (1962), pages 586 through 591, edited by Irving Skeist, Van Nostand Reinhold Company, 450 West 33rd Street, New York, New York 10001. Generally, these adhesives are characterized by the ability to adhere tenaciously upon application with only light finger pressure.

The other side of the base has the following coatings applied. First, a foam coat 5 is applied to give texture, softness to touch and impart a nonslip feeling. Second, a coating 7 is optionally applied having wear resistance. Preferably, this coating is also tacky at room temperature. Finally, a wax coating 9 is applied to provide non-slip and water repellancy.

The foam coat comprises a resinous binder having expandable microspheres contained therein. An example of the preparation of expandable microspheres is set forth in U.S. Pat. No. 3,293,114. Each of the microspheres are synthetic resinous particles having a foaming agent therein. The microspheres are expandable to hollow gas filled monocellular spheres by heating to a temperature within the range of from 85° to 100° C.

The resinous binder for the microspheres can be any thermoplastic resin which softens in the same range as the microspheres when expanded. In addition, the binder is preferably deposited from water emulsion as a solvent system might attack the wall of the expandable microspheres. Nevertheless, an organic solvent system can be used as long as the solvent is a non-solvent for the walls of the microspheres. Examples of resin binders that might be used are polyvinyl acetate homopolymer, polyvinyl acetate copolymer acrylics, styrene butadiene, polyvinyl chloride, polyvinylidere chloride, nitriles, neoprene and methacrylate copolymers.

The amount of microspheres in the foam coating 5 must be sufficient so as to form a textured surface throughout the coating and to impart the desired feel and softness to enhance grip. If an excessive amount of microspheres are added, the coating will disintegrate after the spheres are expanded. Generally, on a dry solids weight basis, the microspheres to binder ratio should range from 5 to 50 parts of microspheres to 100 parts of binder.

The foam coat 5 may be applied by any conventional coating technique such as rod, reverse roll, air knife, etc.

After the coating 5 is applied, the substrate coated with the microspheres is inserted in an oven at a temperature between 85° and 150° C for a sufficient time to allow the coating to reach over temperature at which point the coating expands.

The thickness of the foam coat 5 is not critical and in its expanded state will range from .5 mils to 50 mils. However, the thicker the coating 5 the longer the covering will last. An excellent and preferred way of applying the foam coating is to apply one of the commercially available "Foam Coats" made by the Pierce & Stevens Chemical Corporation of Buffalo, New York. The preferred foam coat is designated and sold as Foam Coat-10E, but others made by this company may also be used. The foam coat has a vinyl acetate acrylic copolymer binder containing expandable microspheres. After coating, heat on the order of 100° C is applied to expand the coating. This coating provides a bulky, light feel such as one gets from cork. The coating is deformable and compressible and thus enhances grip by allowing continuous intimate grip.

After the foam coat has dried, if desired for obtaining some longer wear, but not necessary, otherwise, a coating 7 is applied to assist in improving tack and wear resistance.

To accomplish this, any resinous material which has good wear resistance and a degrees of tack at room temperature can be used. Again this coating is preferably deposited from a water emulsion coating so as not to attack the wall of the underlying microspheres.

The selection of a particular resin for this purpose is a matter of routine well within the skill of a chemist in the art. A particularly suitable resin for this purpose is a nitriel latex made by Goodyear Tire and Rubber Company. The resin is sold as the 520 series and is a carboxy-modified butadiene-acrylonitrile copolymer latex. Selected acrylic copolymers and polyvinyl acetate copolymers can also be utilized. In addition, the same effect can be achieved within a wide range of selected resins by plasticizing the same or by adding a tackifier resin to an otherwise wear resistant non-tacky film. Tackifiers are well known additives for pressure sensitive adhesives as, e.g., described on page 586 of the Handbood of Adhesives hereinbefore referred to. The pressure sensitive adhesives hereinbefore referred to can be utilized modified only by a reduction in the amount of tackifier.

The wear resistant coating 7 may be applied by any conventional coating technique with thickness being not critical ranging, e.g., from 0.1 mil to 10 mils. Actually, the coating 7 will vary in thickness as the underlying foam coat will have hills and valleys.

In order to improve the tackiness or "non-slip" characteristics of the handle covering material, over either the "Foam Coat" layer, alone or after the wear resistant coating has dried, a wax coating is applied. The wax coating acts as a water repellent so that when the present invention is used as a grip, perspiration will not affect the tacky grip. In addition, the heat of a human hand will tend to enhance the tackiness of the grip by causing the wax to flow and become compliant with the surface of the hand. Still further, wax such as beeswax, has a degree of tack.

Tacky beeswax, insect waxes, animal waxes, vegetable waxes or any other wax which are capable of complying with the gripping object may be used. A water emulsion of the wax is formed or wax is dissolved in a solvent which will not attack the wall of the microspheres. The coating is applied using conventional coating techniques.

The wax coating 9 would be less than 1 mil as too much wax would cause it to slip on itself. As in the case of wear resistant coating 7, the wax coating will vary in thickness due to the underlying hills and valleys of the foam coat. At the peaks of the hills, the wax will be less than 0.2 of a mil.

After the coatings have been applied, the handle wrapping may be rolled up for storage, if desired, since the beeswax and the pressure sensitive adhesive are immiscible and no trouble is therefore had in unrolling a roll. The handle wrapping may then be applied to any handle where the pressure sensitive adhesive will cause the base to adhere to the handle. The wrapped handle will have the feel of leather, will not slip and the wrapping will not deteriorate as a result of the effects of perspiration. In any event, the wrapping is relatively inexpensive and can be readily replaced.

If desired, the coatings may be directly applied to a handle without using a substrate, however, it is believed that this would be cumbersome since it is so much simpler to continuously coat a substrate and then wrap some of the substrate around a handle.

Figure 2:
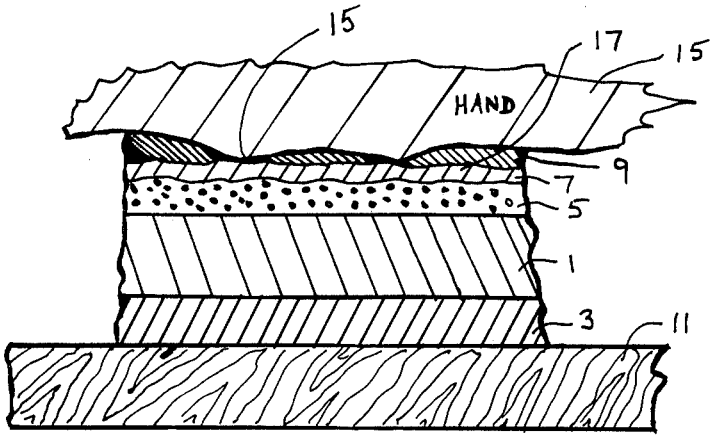
FIG. 2 is an exaggerated cross sectional view of a hand in contact with the non-slip substrate of the present invention.

Referring to FIG. 2, the non-slip material constructed in accordance with the present invention is shown adhered to a surface 11 by adhesive 3 and the surface of a hand 13 bearing against wax surface 9. Foam coating 5 provides a suchioned feel. Wax layer 9, due to the heat of the hand, flows and complies with the hand to create non-slip contact and repel water resulting from perspiration. Layer 7 gives wear resistance. In addition, particularly in areas such as at 15 and 17, layer 7 enhances non-slip due to its tackiness.

EXAMPLES

The following are examples of the present invention:

EXAMPLE I

A stretchable resin impregnated sheet, normally used for tape base stock, was coated with a water solution of Foam Coat containing 25% total solids using a No. 24 rod. The Foam Coat was a vinyl acetate acrylic copolymer binder containing expandable microspheres and was sold by Pierce and Stevens Chemical Corporation of Buffalo, New York as Foam Coat. The expandable microspheres were present in an amount of approximately 20 parts to 100 parts of binder. The coated paper was then placed in a forced hot air preheated oven (250° F) for approximately 60 seconds until the coating dried and the microspheres expanded.

The foam coated paper was then adhered to a tennis racket using a pressure sensitive adhesive.

The foam coated paper gave a velvety, soft feel very similar to that obtained from cork. The surface was deformable and compressible thereby reducing slip by allowing intimate grip contact.

EXAMPLE II

A 10% hot tolulene solution of beeswax, heated to approximately 100° F was applied over the foam coated paper, prepared as in Example I, using a smooth or No. 0 rod. The wax coating was dried in a hot oven at 240° C for 15 seconds.

This wax coated sheet was also adhered to a tennis racket handle.

In use, the wax enhanced grip especially when perspiring as there was no build up on a water layer between the hand and the grip. In addition, a non-slip was increased as the wax, under the heat of the hand, flowed into all the crevices of the hand thereby increasing frictional contact.

EXAMPLE III

A foam coating was prepared as in Example I. A 50% water solution of nitriel latex was coated over the foam coating to provide a wear resistant coating. That was dried in an oven at 240° F for one minute.

The nitriel latex was a carboxy modified butadiene-acrylonitrile copolymer latex sold as the 520 series by Goodyear Tire and Rubber Company.

The sheet so coated was adhered to the handle of a tennis racket. This greatly enhanced wear resistance and also imparted tack as the resin at room temperature has a natural tack associated with it. The feel of the handle also changed to a leather-like feel.

A wax coating was then applied using the same step as set forth in Example II except that the wax was applied over the wear resistant coating. This further enhanced grip without effect on wear. The tack provided by the wear resistant coating came through the wax is selected areas to give a desired combined effect.

There has accordingly been described herein a novel and useful handle wrapping material which can be used to replace other wrapping materials, which is relatively inexpensive and performs better than other materials.

The novel features of the invention are set forth with particularity in the appended claims.

What is claimed is:

1. A non-slip material comprising:

a. a substrate, b. a compressible coating on said substrate comprising a resinous binder having gas filled expanded microspheres therein, c. a wax coating on said compressible coating to impart water repellancy and compliability thereto.

2. The non-slip material as defined by claim 1, a wear resistant and tacky coating between said compressible coating and said wax coating.

3. The non-slip material defined by claim 2, a pressure sensitive adhesive coated on said substrate opposite said other coatings.

4. The non-slip material defined by claim 1, wherein said compressible coating includes 5 to 50 parts of microspheres to 100 parts of resinous binder.

5. The non-slip material defined by claim 1, wherein said wax comprises beeswax.

6. The non-slip material defined by claim 1, wherein said resinous binder is a vinyl acetate acrylic copolymer.

7. A non-slip material comprising:

a. substrate, b. a compressible coating on one surface of said substrate comprising a resinous binder having gas filled microspheres therein, c. a wear resistant and tacky coating on said compressible coating comprising a carboxy-modified butadiene acrylonitrile copolymer, d. a pressure sensitive adhesive coated on a surface of said substrate opposite the said on surface.

* * * * *